US006626554B2

(12) United States Patent
Rincover et al.

(10) Patent No.: US 6,626,554 B2
(45) Date of Patent: Sep. 30, 2003

(54) LIGHT APPARATUS

(76) Inventors: Aaron Nathan Rincover, 62 Moulton Ave. No. 102, Los Angeles, CA (US) 90031; Jonathan Richard Coles, 47 Bounds Green Road, London N22 7HB (GB); Simon Christopher Maidment, Garden Flat, 108 Huddleston Road, Islington London, N7 0EG (GB)

( * ) Notice: Subject to any disclaimer, the term of this patent is extended or adjusted under 35 U.S.C. 154(b) by 0 days.

(21) Appl. No.: 09/832,305

(22) Filed: Apr. 10, 2001

(65) Prior Publication Data

US 2002/0012246 A1 Jan. 31, 2002

Related U.S. Application Data

(60) Provisional application No. 60/205,049, filed on May 18, 2000.

(51) Int. Cl.[7] ..... F21L 1/00

(52) U.S. Cl. ..... 362/186; 362/234; 362/253; 362/231; 362/189

(58) Field of Search ..... 362/183, 276, 362/231, 363, 240, 227, 249, 186, 189, 96, 234, 253; 446/486

(56) References Cited

U.S. PATENT DOCUMENTS

| | | | | | |
|---|---|---|---|---|---|
| 4,985,813 | A | * | 1/1991 | Putman | 362/186 |
| 5,649,758 | A | * | 7/1997 | Dion | 362/103 |
| 5,964,639 | A | * | 10/1999 | Maxim | 446/437 |
| 6,065,851 | A | * | 5/2000 | So | 362/103 |
| 6,146,001 | A | * | 11/2000 | Cwiakala | 362/267 |
| 6,341,874 | B1 | * | 1/2002 | Rubin | 362/103 |
| 6,485,169 | B1 | * | 11/2002 | Ragner | 362/500 |
| 6,533,436 | B2 | * | 3/2003 | Krietzman et al. | 362/200 |

* cited by examiner

*Primary Examiner*—Thomas M. Sember
*Assistant Examiner*—Anabel Ton

(57) ABSTRACT

The invention provides a lighting apparatus comprising a hollow elastomeric body in which are encased a means for receiving electrical power such as battery terminals, and at least one light-emitting means such as an LED. One or more parts of the hollow elastomeric body are translucent, and light from the light-emitting means is transmitted through the translucent parts of the body in use to produce an attractive diffuse lighting effect. The light emitting means are actuable by means of a latch switch embedded within the hollow elastomeric body. In use a user squeezes the exterior surface to latch the switch to cause the apparatus to light, and may then safely handle the apparatus.

29 Claims, 9 Drawing Sheets

LIGHT APPARATUS

This application corresponds to and claims priority from U.S. provisional application No. 60/205,049 entitled "Visopia Light System" in the name of Aaron Rincover, filed May 18, 2000.

TECHNICAL FIELD

The present invention relates to a light apparatus, and in particular to a light apparatus wherein a light source is at least partially encased by an elastomeric body.

PRIOR ART

Various portable light apparatuses are known in the prior art. A particularly well-known type of portable light apparatus is that of the portable torch. The usual configuration of a portable torch is that a main body is provided with an electrical power supply in the form of batteries disposed within the body. A switch is usually provided in the outer surface of the body electrically coupled to the batteries and a light emitting means in the form of a bulb. The bulb is usually provided within a transparent casing provided at one end of the torch body. Upon activating the switch electrical current is caused to flow through the bulb thereby causing it to light. The light from the bulb is transmitted directly through the transparent casing and can also be reflected through the transparent casing by a reflective cone arranged around the bulb, thereby producing a focussed illumination beam which can be directed onto objects by suitable pointing of the torch body. In order to render the torch body more durable to accidental impacts, it is further known that the body can be encased in a plastic or rubber coating to provide the torch body with a degree of resilience. When such a plastic or rubber coating is provided, however, it is not known for the coating to extend over the transparent casing containing the light emitting means in the form of a bulb, for the reason that the illuminating beam from the bulb should be transmitted with the maximum intensity possible.

SUMMARY OF THE INVENTION

It is an object of the present invention to provide a light apparatus that is particularly adapted for handling by a user.

It is another object of the present invention to provide a light apparatus that is pleasant for a user both to touch and to view.

In order to meet the above objects, according to the present invention there is provided a light apparatus comprising: means for receiving electrical power, at least one light-emitting means electrically coupled to the means for receiving electrical power; and a hollow elastomeric body at least a part of which is substantially translucent; wherein the means for receiving electrical power and the light-emitting means are disposed within the hollow elastomeric body so as to be at least partially encased thereby, the light emitting means being further arranged with respect to the hollow elastomeric body such that in use light is transmitted through the or each part of the body which is substantially translucent By arranging that the light produced by the light emitting means is transmitted through the or each part of the hollow elastomeric body which is substantially translucent, an attractive diffuse lighting effect is obtained. Furthermore, the provision of the hollow elastomeric body to at least partially encase the light emitting means both allows and encourages a user to handle the light comfortably.

In a preferred embodiment, the hollow elastomeric body of the present invention is resiliently deformable, and is preferably formed from silicone. This has the advantage that in use a user may squeeze and exert pressure on the light apparatus, without damaging any of the electrical components that may be contained therein. The use of silicone allows the lighting apparatus of the present invention to be formed in almost any shape whilst retaining the resiliently deformable characteristic of the apparatus. Furthermore, by using silicone it is possible to form the hollow elastomeric body using injection molding.

The material composition from which the hollow elastomeric body is formed is preferably chosen to have a Shore Hardness rating A of between about 2 to 15. In the preferred embodiment of the inventions the silicone composition is chosen to provide a Shore Hardness rating A of approximately 7. By ensuring the material has a Shore-A rating within this range then the resulting hollow elastomeric body will have a suitably soft feel to the touch, without being too detrimental to the durability of the body.

Moreover, the material forming the hollow elastomeric body is preferably capable of elongation of between 200 to 400%. In the preferred embodiment the silicone composition is preferably chosen to have an elongation factor of 400%. Such a value facilitates manufacture of the lighting apparatus by allowing the body to be stretched for insertion of those elements to be contained therein, but does not render the material too soft or elastic such that its durability is reduced. If the chosen material is too soft or too elastic, then it can be prone to splitting and other damage both during manufacture and in use.

In order to enhance the diffuse lighting effect provided by the translucent properties of parts of the hollow body the composition of the material forming the hollow elastomeric body preferably includes a diffusing agent in the proportion of between about 1 to 5% by weight. Preferably the diffusing agent is in the form of a powder, the particles of which are embedded within the material once formed. In the preferred embodiment a proportion 3% wt of powder diffusing agent is used.

In the preferred embodiment, at least one rechargeable battery is provided within a battery compartment which forms part of the means for receiving electrical power. The light apparatus is also further provided with an electrical input terminal electrically coupled to the rechargeable battery, the electrical input terminal being arranged for receiving an electrical connector for supplying electrical current to the battery from a power supply. By providing a rechargeable battery and means for recharging the battery within the light apparatus, the light apparatus can be operated independent of a mains power supply, and becomes portable. In particular, by eliminating any power cord necessary to supply electrical power to the lighting apparatus, the apparatus becomes more pleasurable for the user to play with.

In alternative embodiments, the means for receiving electrical power further comprise a power cable extending out of the hollow elastomeric body, and suitable for connection to a mains electrical power supply, either directly or via a DC power supply.

The preferred embodiment preferably further comprises a light activation means electrically coupled to the or each light emitting means and the means for receiving electrical power, and arranged to activate the light emitting means as required by the user. Preferably, the light activation means is disposed within the hollow elastomeric body, and is further arranged to be actuable in response to pressure exerted on an exterior surface of the hollow elastomeric body. With such an arrangement it becomes possible for the user merely to squeeze the external surface of the hollow elastomeric body in order to activate the light emitting means. By using a single pole latch switch, the user need only squeeze the outer surface of the hollow elastomeric body once in order to activate the light emitting means, which will then continue to emit light until the user squeezes the outer surface of the hollow elastomeric body once again in order to unlatch the switch and deactivate the light emitting means.

Moreover, the preferred embodiment may also comprise means defining cavities within the hollow elastomeric body. Such means may preferably take the form of a plurality of inwardly extending protrusions provided on the inner surface of the body. By providing cavities within the hollow body, the hollow body is made to feel softer to a user, thereby enhancing the tactile qualities of the light apparatus.

Within the preferred embodiment, the light apparatus preferably further comprises an inner pod disposed within the hollow elastomeric body and arranged to contain the means for receiving electrical power and the light emitting means therein. The inner pod is preferably formed from substantially rigid material, and acts to protect the light emitting means and means for receiving electrical power.

Preferably, the or each light emitting means is a light emitting diode. Each light emitting means can be further arranged to emit light of different colours. Particularly, where a plurality of light emitting means are provided, each light emitting means may emit either a single colour or different consecutive colours.

Where the light emitting means can emit light of different colours, preferably a control means is provided for controlling the light emitting means to emit light of different colours, the control means preferably using pulse width modulation controlling the or each light emitting means. By providing for the light emitting means to emit different colors, different attractive lighting effects can be obtained.

BRIEF DESCRIPTION OF THE DRAWINGS

Further features and advantages of the present invention will become apparent from the following description of the preferred embodiment which represents the best mode of the invention, presented by way of example only, and with reference to the accompanying drawings which depict the preferred embodiment corresponding to the best mode of the invention, and wherein.

DESCRIPTION OF THE PREFERRED EMBODIMENTS

A preferred embodiment of the lighting apparatus of the present invention and which represents the best mode of the invention will now be described with reference to FIGS. 1 to 15.

Figure 1:
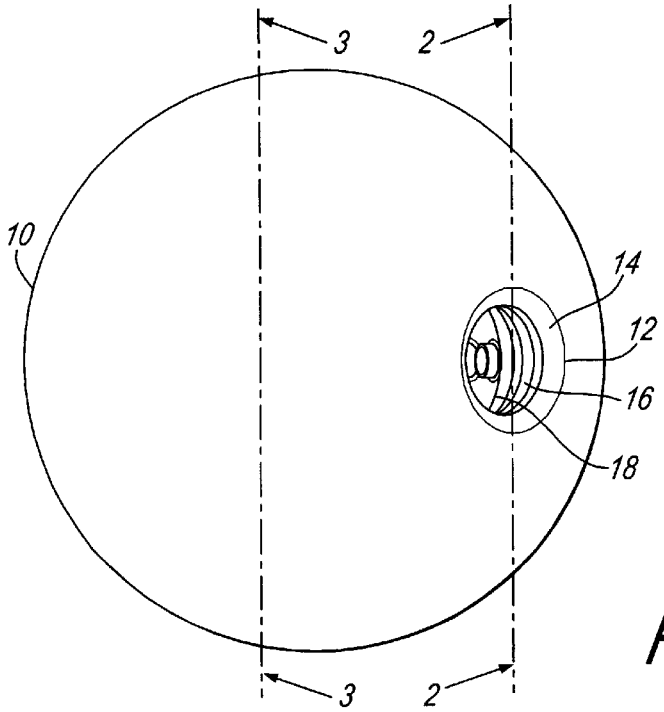
FIG. 1 shows a perspective external view of the hollow elastomeric body of the invention.

With reference to FIG. 1, the lighting apparatus of the present invention comprises a hollow elastomeric body which in the preferred embodiment is in the shape of a sphere 10. In the preferred embodiment, the sphere 10 is integrally formed using injection molding of silicone. The resulting molded sphere 10 has a smooth external surface, and is hollow on the inside. A circular aperture 12 is provided into the hollow interior of the sphere, the aperture 12 being molded in the mold so as to provide a first flange 14, a second flange 16 and a third flange 18 of increasing diameter extending from the outer opening 12 into the hollow interior through the side wall of the sphere 10.

Figure 2:
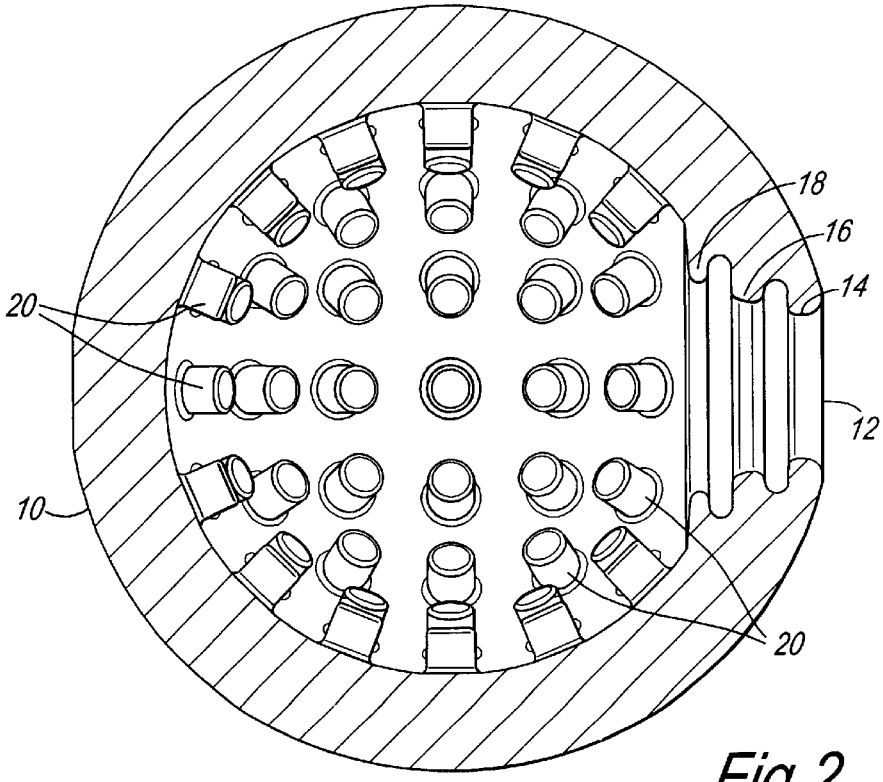
FIG. 2 shows a cross-section of the hollow elastomeric body of the present invention along the line 2—2 of FIG. 1 and looking in the direction of the arrows.

FIG. 2 illustrates a cross-section along the line 2—2 of FIG. 1 and looking in the direction of the arrows. From FIG. 2 it will be seen that the interior surface of the sphere 10 is provided with a plurality of inwardly extending protrusions formed on the inner wall of the hollow interior. The protrusions 20 are equally arranged in both dimensions on the interior wall of the sphere 10 and due to the hollow interior being spherical in shape, each protrusion extends in a direction towards the centre of the sphere 10. In the preferred embodiment, the protrusions 20 are integrally formed with the hollow sphere 10 by injection molding in a suitably shaped mold. Therefore each protrusion 20 is formed from silicone.

Figure 3:
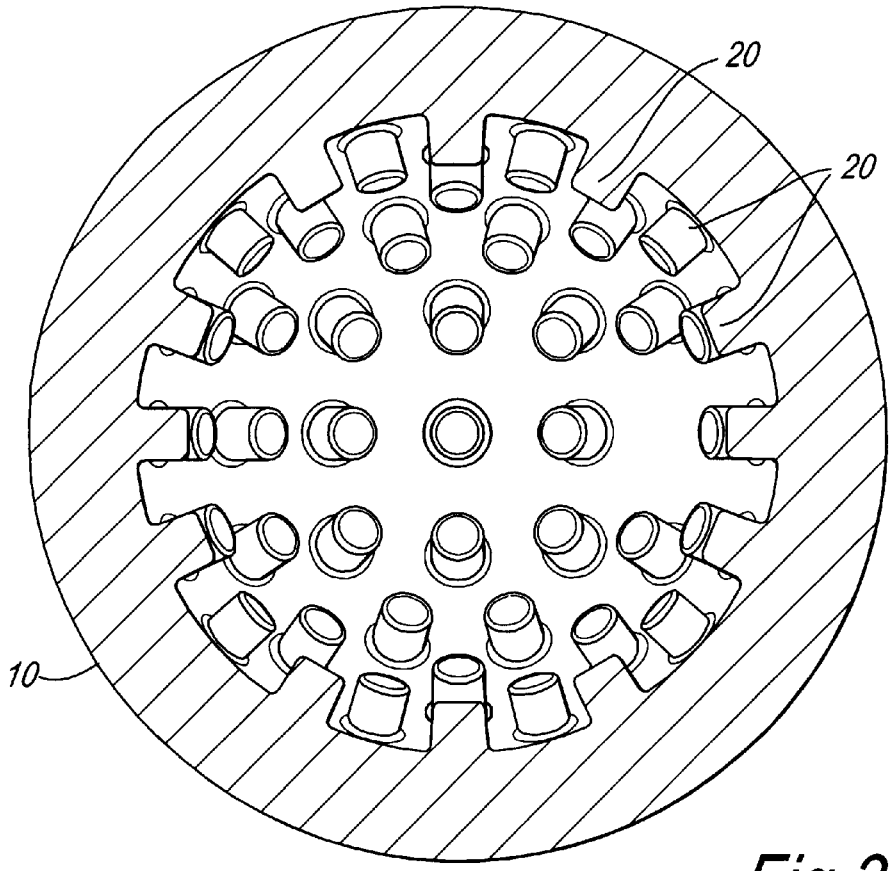
FIG. 3 illustrates a cross-section of the hollow elastomeric body of the present invention along the Line 3—3 of FIG. 1 and looking in the direction of the arrows.

FIG. 3 illustrates a cross-section along the line 3—3 of FIG. 1 and looking in the direction of the arrows. From FIG. 3 it will be seen that the protrusions 20 extend across the entire inner wall of the hollow interior of the sphere 10, and are equally spaced from each other. In addition, from FIG. 3 it will be seen that in the preferred embodiment the protrusions 20 are substantially cylindrical in shape, although can be slightly narrower at the distal end of each protusion from the interior wall than at the proximal end, in order to aid in removal of the protrusions from the mold during manufacture. In the preferred embodiment, each protrusion 20 is of equal size to every other protrusion.

Figure 4:
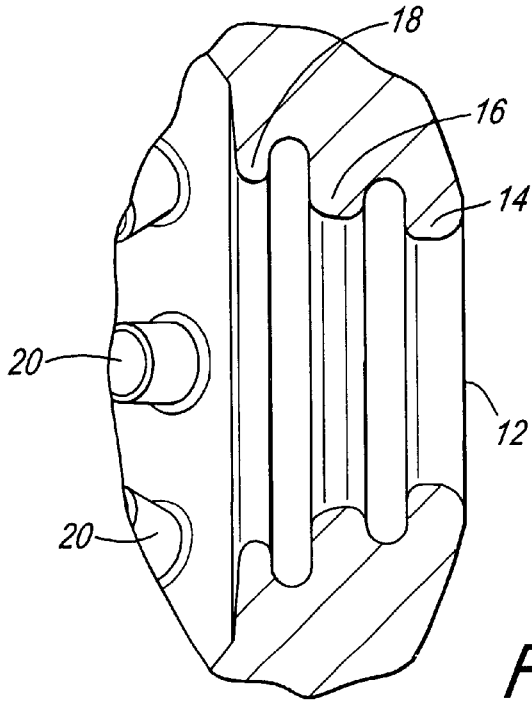
FIG. 4 is a close up view of a cross-section of an opening provided in the hollow elastomeric body of the present invention.
Figure 5:
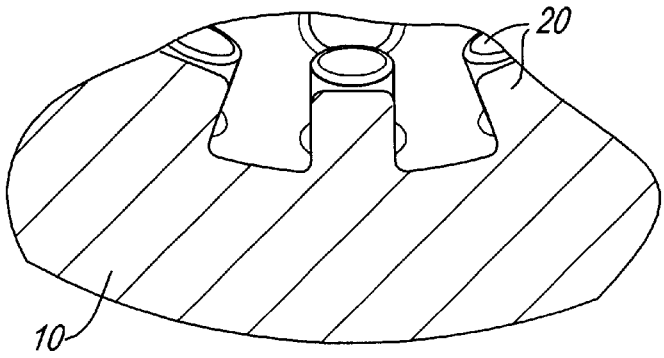
FIG. 5 is a close up view of a cross-section of part of the hollow elastomeric body of the present invention.

FIG. 4 illustrates a close up of the flanges 14, 16 and 18 provided in the aperture within the side wall of the sphere 10. From FIG. 4, it will be seen that the flanges 14, 16 and 18 are integrally formed with the side wall, and therefore in the preferred embodiment are formed from a silicone. The aperture 12 is circular in shape, and therefore the flanges 14, 16 and 18 are also circular. However, the flanges 14, 16 and 18 respectively increase in diameter but reduce in thickness from the outer surface of the sphere. That is, the outer circular flange 14 defines a circular opening of a reduced diameter compared to the flanges 16 and 18, and the middle flange 16 defines a circular opening of a reduced diameter compared to the flange 18 However, the lip of the flange 14 is thicker in an axial direction of the aperture 12 than that of the lip of the flanges 16 and 18. Furthermore, the lip of the flange 16 is thicker in an axial direction of the aperture 12 than the flange 18.

The material composition from which the hollow elastomeric body is formed is preferably chosen to have a Shore Hardness rating A of between about 2 to 15. In the preferred embodiment of the invention, the silicone composition is chosen to provide a Shore Hardness rating A of approximately 7. By ensuring the material has a Shore-A rating within this range then the resulting hollow elastomeric body will have a suitably soft feel to the touch, without being too detrimental to the durability of the body.

Moreover, the material forming the hollow elastomeric body is preferably capable of elongation of between 200 to 400%. In the preferred embodiment the silicone composition is preferably chosen to have an elongation factor of 400%. Such a value facilitates manufacture of the lighting apparatus by allowing the body to be stretched for insertion of those elements to be contained therein (described later), but does not render the material too soft or elastic such that its durability is reduced. If the chosen material is too soft or too elastic, then it can be prone to splitting and other damage both during manufacture and in use.

In order to enhance the diffuse lighting effect provided by the translucent properties of parts of the hollow body the composition of the material forming the hollow elastomeric body preferably includes a diffusing agent in the proportion of between about 1 to 5% by weight. In the preferred embodiment the sphere 10 contains a diffusing agent is in the form of a powder, the particles of which are mixed with the silicone composition such that they are embedded within the silicone material once the sphere is formed in the mold. In the preferred embodiment a proportion of 3% wt of powder diffusing agent is used.

The powder diffusing agent can be any suitable powder of which the particle size is small enough to produce the diffusion effect. Metal oxide powders such as zinc oxide or magnesium oxide can produce the required effects whilst being substantially chemically neutral and non-toxic. Moreover, metal oxides are naturally available in different colours depending upon the particular metal, which can be important depending on the colour chosen for the silicone composition.

The sphere 10 preferably has a matte finish to its exterior surface. This is achieved by the mold used to form the sphere having a corresponding grade of finish to give it a matte effect.

Figure 6:
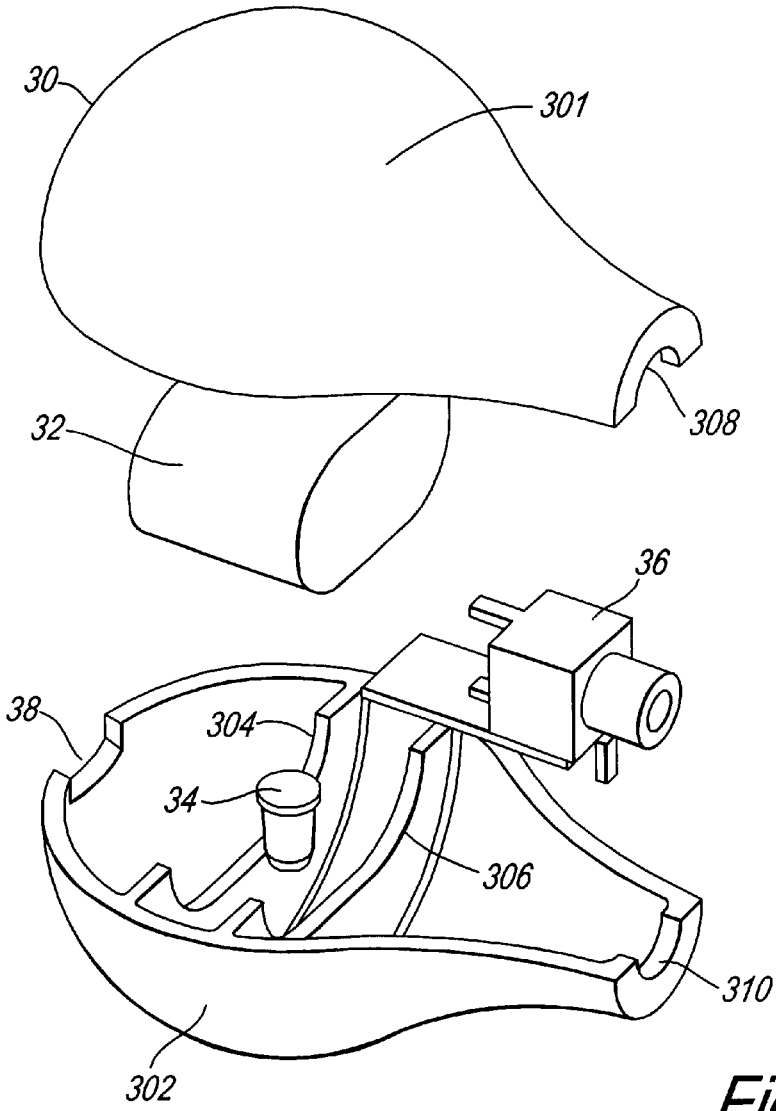
FIG. 6 is an exploded assembly view of a sub-assembly forming part of the lighting apparatus of the present invention.

Disposed within the sphere 10 in the preferred embodiment is an inner sub-assembly 30, an exploded perspective view of which is shown in FIG. 6. The inner sub-assembly 30 comprises a first shell half 301 and a second shell half 302. Each shell half 301 and 302 is shaped so that when assembled together they form a bulb shaped shell having a narrow neck portion at one end and a bulbous body portion at the other end. Each shell half 301 and 302 is provided with a respective semi-circular aperture 308 and 310 in the narrow end wall of each shell half. Furthermore, a rectangular aperture 38 is provided in the side wall of the large end of the shell half 302. A corresponding rectangular aperture is also provided in the large end of the shell half 301, although this is not shown in the drawing. When the shell-halves 301 and 302 are assembled together, the semi-circular apertures 308 and 310 are brought together to form a circular aperture (as shown in FIG. 7*b*), whereas the rectangular aperture 38 in the shell-half 302 and he corresponding rectangular aperture (not shown) in the shell half 301 form a square aperture in the side wall of the bulbous end of the inner sub-assembly.

Each shell half 301 and 302 is further provided with corresponding inner walls 304 and 306 extending across the long axis of each shell half. The walls 304 and 306 are preferably integrally formed with the shell halves 301 and 302 and act to brace the sub-assembly against any external force which may be applied thereto. It should be understood that each shell half 301 and 302 is provided with its own respective internal walls 304 and 306 which are correspondingly positioned in each shell half such that when the two halves are put together to form the complete assembly the corresponding respective walls are located adjacent each other.

The inner sub-assembly 30 formed from the shell halves 301 and 302 is formed from a rigid material such as rigid plastic or epoxy resin.

The inner sub-assembly 30 in the preferred embodiment is arranged to contain a rechargeable battery 32, at least one light emitting means 34 in the form of an LED, and an electrical input terminal 36 arranged to receive an electrical connector for supplying electrical power to the rechargeable battery 32. The battery 32, the LED 34 and the electrical input terminal 36 are electrically coupled via a circuit mounted on a PCB, which for clarity reasons is not shown in FIG. 6. The assembly of the battery 32, the LED 34 and the input terminal 36 will be described next with respect to FIGS. 12 to 15.

With reference to FIGS. 12 to 15, a Printed Circuit Board (PCB) 82 is provided, upon the upper major surface of which is mounted an electrical switch 84. Electrical switch 84 is a single-pole latch switch and is provided with an actuation member 841 which extends vertically upwards out of the switch body 84. The actuation member 841 is depressible in the direction into the page with reference to FIG. 12, or down the page with reference to FIG. 14. Depression of the member 841 causes electrical contacts within the switch body 84 to latch closed. A subsequent depression of the actuation member 841 in the same direction causes the electrical contacts provided within the switch body 84 to unlatch, and thereby open. The PCB 82 is further arranged to mount a plurality of LEDs 34 provided extending from the lower major surface of the PCB 82, and mounted on the PCB 82 by a solder connection to the legs of the LEDs in the usual manner in the art. The LEDs 34 form the light-emitting means of the present invention.

Figure 13:
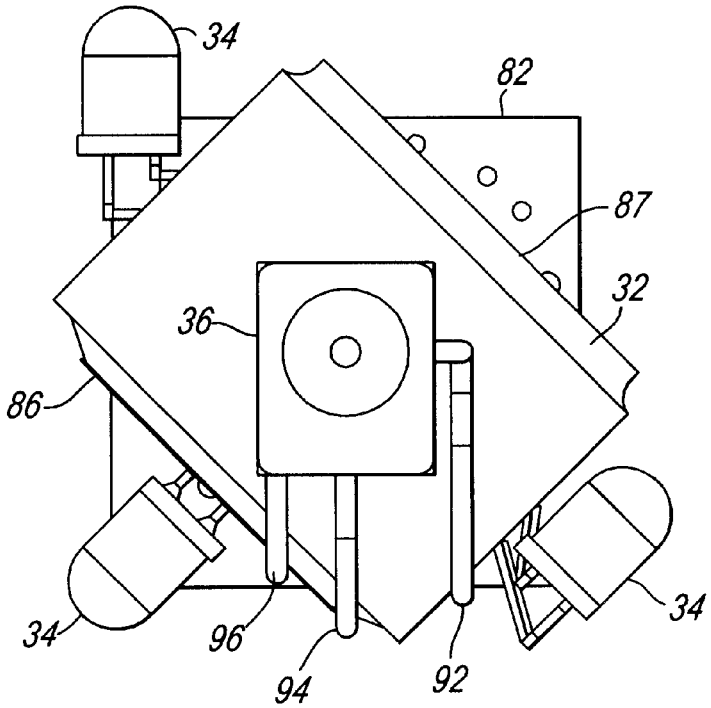
FIG. 13 is a bottom plan view of the PCB assembly shown in FIG. 12.
Figure 14:
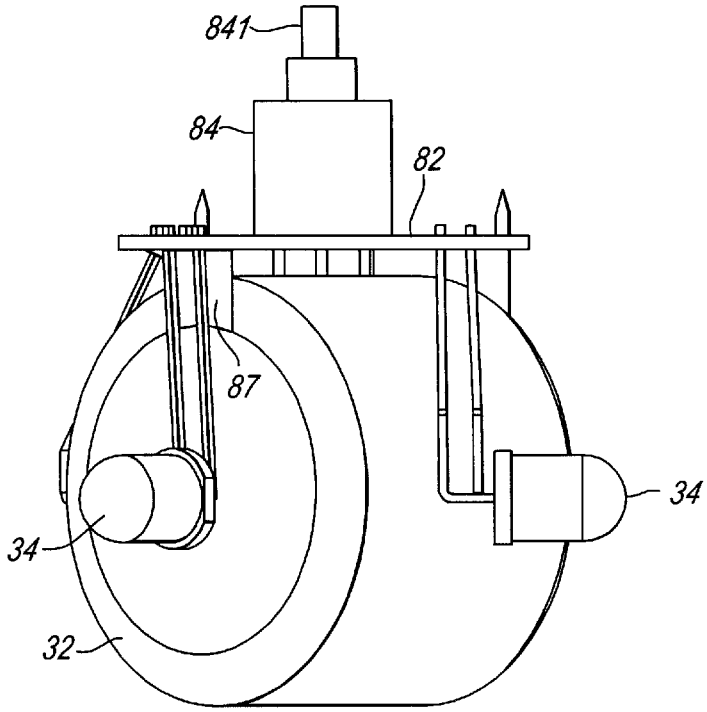
FIG. 14 is a side elevation view of the PCB assembly shown in FIGS. 12 and 13.

In addition, a first terminal plate 86 and a second terminal plate 87 also extend from the lower major surface of the PCB 82 in a downwards direction with reference to FIG. 14, or a direction out of the page with reference to FIG. 13. Between the terminal plates 86 and 87 is disposed a battery pack 32 the positive and negative contacts of which are arranged to contact one of the terminal plate 86 and 87 respectively. In the preferred embodiment, the battery pack 32 is a Ni—MH rechargeable battery. The battery pack 32 itself may be a single battery cell, or a plurality of cells arranged in series. The electrical power requirements of the battery pack are such that it should be capable of supplying sufficient current at a suitable voltage to light the LEDs for several hours.

Figure 15:
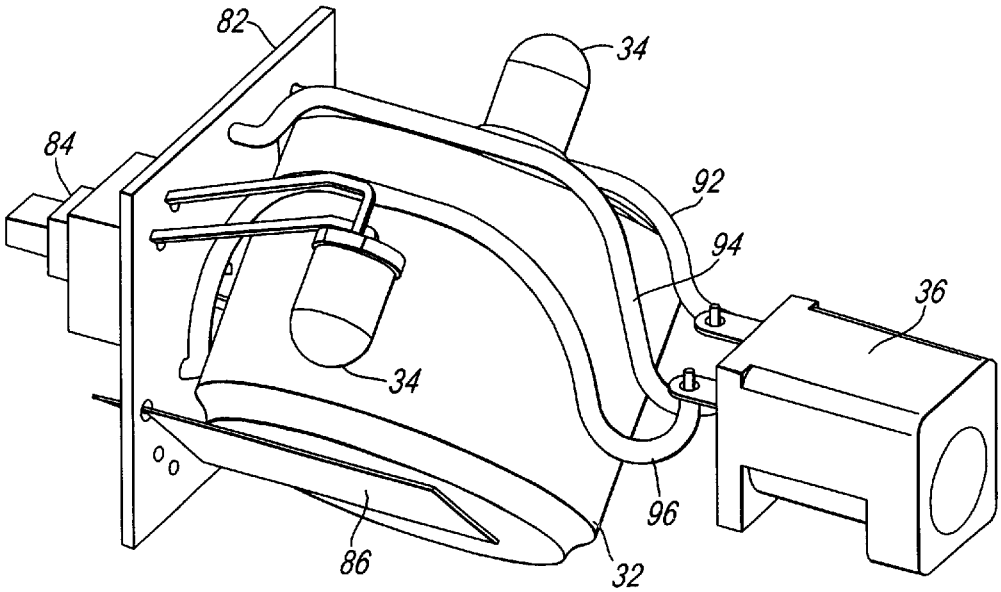
FIG. 15 is a side perspective view of the PCB assembly shown in FIGS. 12, 13 and 14.

Disposed beneath the battery in a direction out of the page with reference to FIG. 13 and across the page with reference to FIG. 15 is an electrical input terminal 36 comprising a plastic housing provided with an input socket for receiving a pin connector as are commonly provided from DC power supplies. The housing 36 is further provided with three electrical output terminals, which are respectively connected to connecting wires 92, 94 and 96. The connecting wires 92, 94 and 96 extend from the output terminals on the housing across the battery pack 32 to the lower major surface of the PCB 82, whereupon they terminate with electrical connections on the PCB.

With respect to the LEDs 34, it will be seen that within the preferred embodiment a total of three LEDs are separately provided downwardly extending from the lower major surface of the PCB, but with the heads of each LED angled through 90° such that beams of light produced by the LEDs in operation extend in a plurality of directions perpendicularly away from the long axis of the PCB assembly arrangement. While the drawings of the preferred embodiment show three LEDs it will be understood by the man skilled in the art that a greater or fewer number of LEDs can be employed.

The PCB 82 provides a number of circuit tracks on one or both of the upper and lower major surfaces thereof to connect the aforementioned components to create an electrical circuit. The electrical circuit created by the PCB tracks and the components is shown in FIG. 11.

Figure 11:
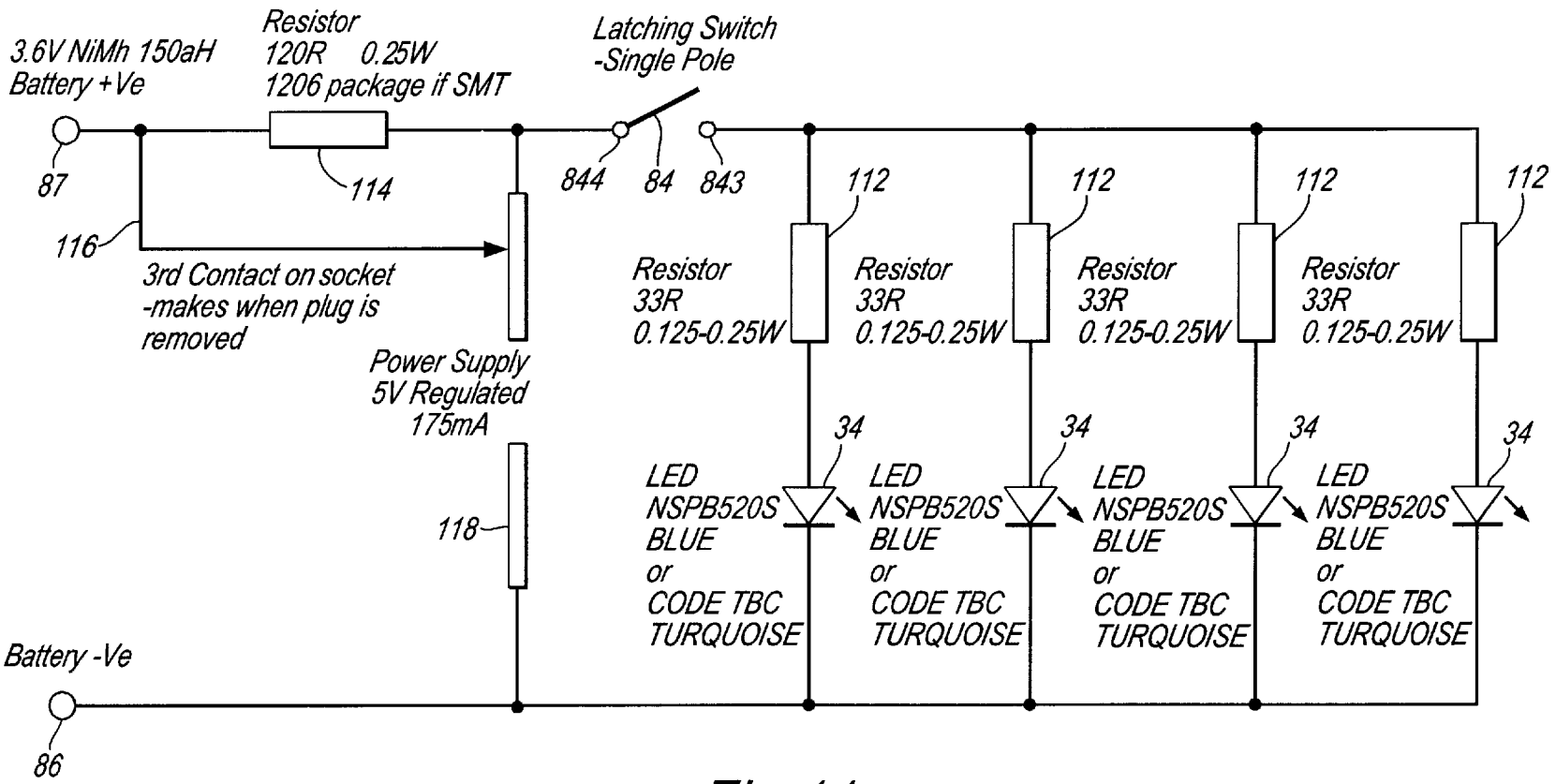
FIG. 11 is a circuit diagram of the electrical circuit employed in an embodiment of the lighting apparatus according to the present invention.
Figure 12:
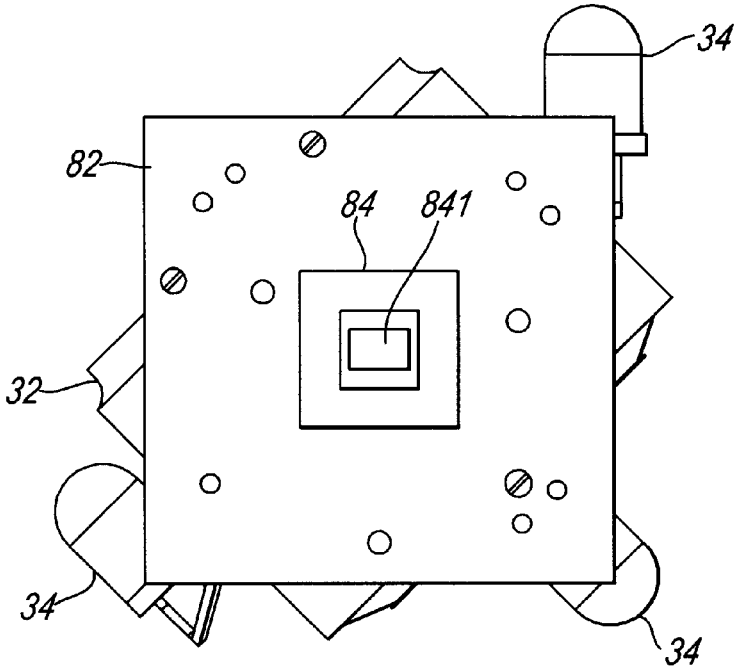
FIG. 12 is a top plan view of a PCB assembly used in an embodiment of the lighting apparatus of the present invention.

With reference to FIG. 11, it will be seen that a plurality of LEDs 34 are provided each arranged in series with a resistor 112. Each resistor 112 and LED 34 pair is electrically connected in parallel wit each other resistor-LED pair. The negative terminals of each LED are connected to one of the electrical terminals 86 electrically coupled to the negative terminal of the battery pack. The positive terminals of each LED are respectively connected to the negative terminal of the corresponding resistor in each resistor-LED pair. The positive terminals of each resistor are connected to the single-pole output terminal 843 of the latching switch 84. An input terminal 844 of the latching switch 84 is electrically coupled to one end of a biasing resistor 114, which is connected between the latching switch and the electrical terminal 87, the electrical terminal 87 being electrically coupled to the positive terminal of the battery pack 32. In addition, a 4.5 volt regulated power supply 118 is connectable between the input terminal 844 of the latching switch and the terminal 86 connected to the negative terminal of the battery pack. The five volt regulated power supply is connectable into the PCB via the electrical input terminal 36 which is connected by the wires 92, 94 and 96 to the PCB as described earlier and shown in FIG. 15. The PCB in combination with the wires 92, 94 and 96 and the electrical input terminal 36 provide an additional third contact within the socket of the electrical input terminal 36, the third contact being made when a connector pin from the five volt regulated power supply is removed from the socket on the electrical input terminal 36, as indicated on the circuit diagram. This arrangement acts to switch the voltage from the power supply when the pin therefrom is inserted into the socket on the electrical input terminal 36 across the terminals 87 and 86 in order to recharge the battery pack 32.

It should be noted that FIG. 11 depicts four LED and resistor pairs, whereas FIGS. 12 to 15 depict only three LEDs. However, as mentioned earlier, it is possible to have a greater or fewer number of LEDs electrically connected into the PCB 82, as required. To provide only three LEDs, the circuit of FIG. 11 should be modified to remove one of the LED-resistor pairs.

Figure 7A:
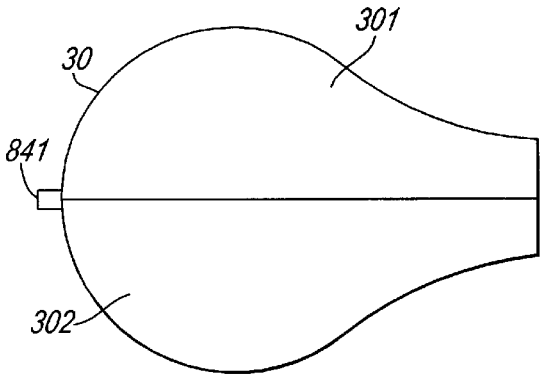
FIG. 7*a* is a side elevation view of the sub-assembly forming part of the lighting apparatus of the present invention.
Figure 7B:
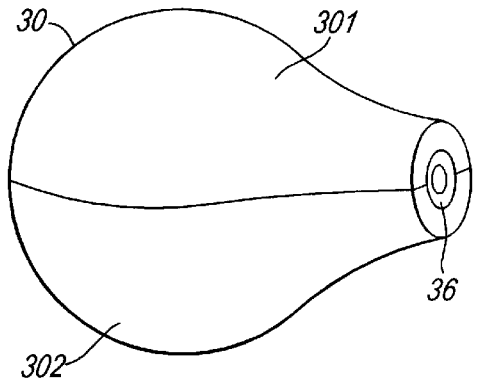
FIG. 7*b* is a side perspective view of the sub-assembly used in the lighting apparatus.

Returning now to a consideration of the inner sub-assembly 30 shown in FIGS. 6 and 7, the PCB assembly as described above with respect to FIGS. 12 to 15 is arranged to fit inside the inner sub-assembly 30 and rest against the bracing walls 304 and 306 provided in the respective shell halves 301 and 302. As described previously the shell halves 301 and 302 fit together to contain the PCB assembly therein, and the external appearance of the assembled inner sub-assembly is shown in FIG. 7. FIG. 7*a* is a side elevation view of the assembly inner sub-assembly, from which it can be seen that the shelf halves 301 and 302 fit together to form the bulb shaped inner sub-assembly. The rectangular apertures 308 provided in the large end of each shell half form a square aperture through which protrudes the actuating member 841 of the latch switch 84. Furthermore, at the opposite end of the sub-assembly 30 the semi-circular apertures 308 and 310 of the respective shell halves 301 and 302 together form a circular aperture through which the electrical input connector 36 is accessible, as shown in FIG. 7*b*.

Having described the sub-elements of the light apparatus of the present invention it will now be described how those sub-elements fit together to give the assemble light apparatus, with reference to FIGS. 8 to 10.

Figure 8:
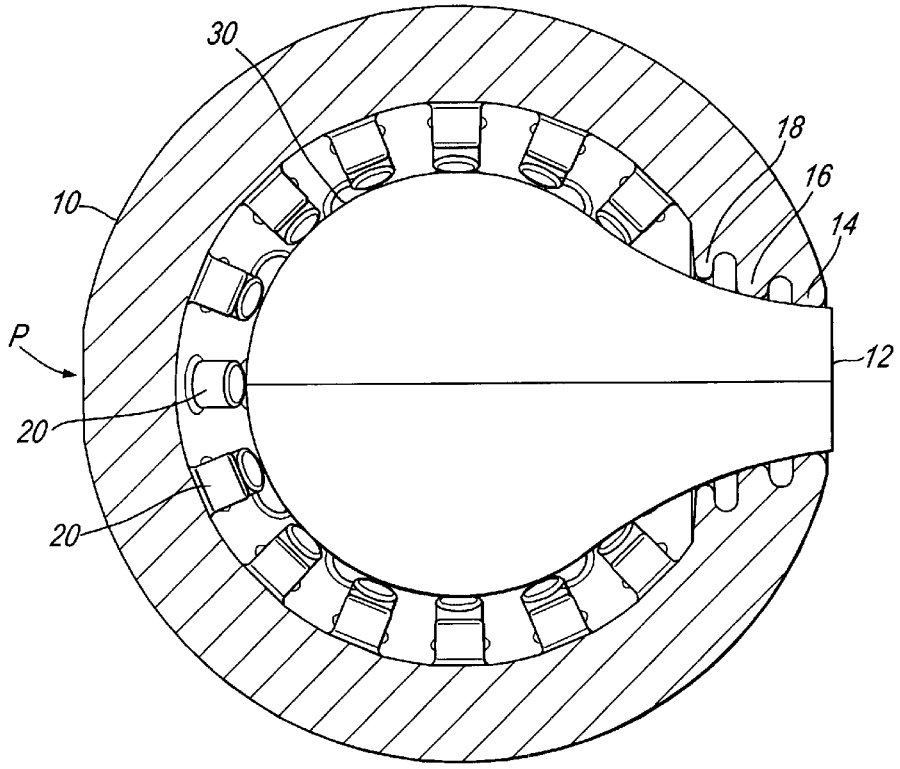
FIG. 8 is a partial cross-section of the lighting apparatus of the present invention depicting the sub-assembly disposed within the hollow elastomeric body.

With reference to FIG. 8 it will be seen that in order to obtain the complete light apparatus of the preferred embodiment of the present invention, the inner sub assembly 30 is inserted into the interior of the hollow sphere 10 so that the exterior surface of the inner sub assembly 30 rests against the distal ends of the protrusions 20. The narrow neck portion of the inner sub assembly 30 extends from the interior of the sphere 10 where the major body portion of the sub assembly 30 is disposed into the aperture 12 formed from the flanges 14, 16 and 18. The flanges 14, 16 and 18 being formed from silicone are elastic, and can be stretched to accept the neck portion of the inner sub assembly 30 and grip the neck portion to hold the inner sub assembly 30 in place. Each protrusion 20 is arranged to extend such that the distal end of each protrusion from the inner wall of the sphere 10 contacts with the outer surface of the inner sub-assembly 20, thereby supporting the inner sub-assembly 30 no matter what the orientation of the sphere 10.

Figure 9:
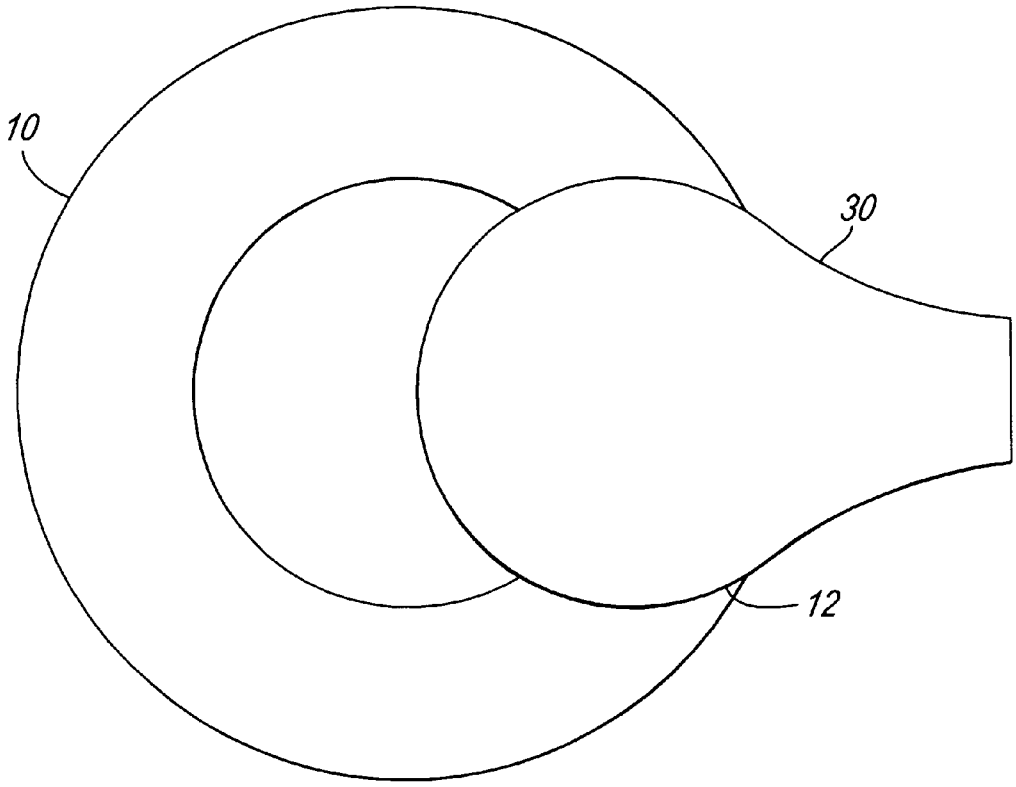
FIG. 9 illustrates how the sub-assembly is inserted in to e hollow elastomeric body.
Figure 10:
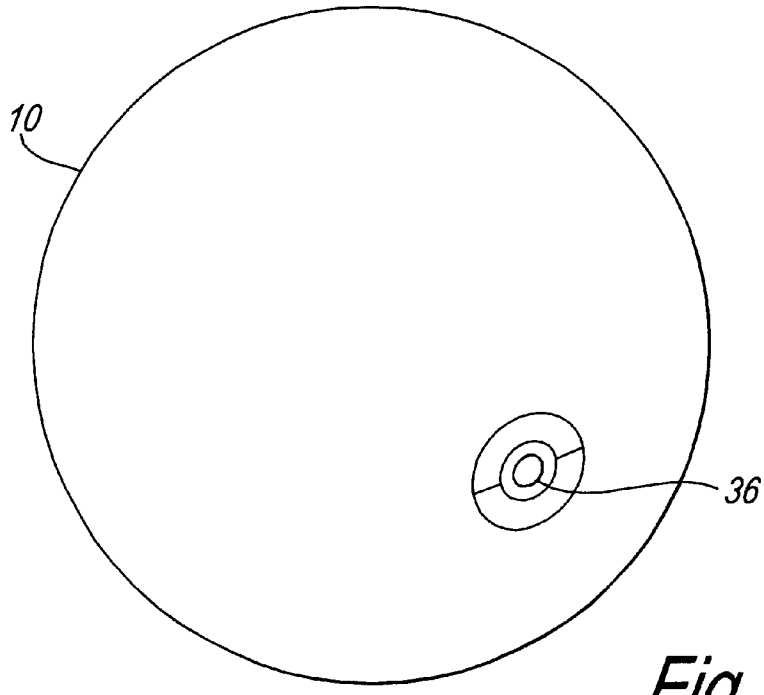
FIG. 10 is a perspective view of the complete lighting apparatus of the present invention when assembled.

FIG. 9 depicts how the inner sub assembly 30 is inserted into the sphere 10 in that due to the highly elastic silicone forming the sphere 10 it becomes possible to stretch the aperture 12 to a sufficient extent to permit the major body portion of the inner sub assembly 30 to be inserted therethrough into the hollow interior of the sphere 10. Once the inner sub assembly 30 has been inserted in the sphere 10, the only element that is visible from the outside is the upper face of the narrow neck portion, bearing the circular aperture in which the electrical input terminal 36 is disposed, as shown in FIG. 10. It is necessary for the electrical input terminal 36 to be visible and accessible to permit for a connector pin from the regulated power supply discussed previously in relation to the circuit shown in FIG. 11 to be connected into the electrical input terminal 36 for recharging of the battery pack 32 contained within the sub assembly 30.

Returning to FIG. 8, it will be seen that the inner sub-assembly 30 sits within the hollow interior of the sphere 10 supported by the protrusions 20. The protrusions 20 act to support the inner sub assembly 30. In addition the gaps between each protrusion 20 provide in effect one or more air cavities around the inner sub-assembly 30 between the outer surface thereof and the inner wall of the hollow inner sphere 10. The provision of this air cavity or cavities between the protrusions 20 acts to cause the sphere to appear softer to the touch to a user who may be handling the light apparatus. Therefore the tactile and sensory feel of the light apparatus is enhanced.

Furthermore, it will be apparent from FIG. 8 in combination with FIG. 7A that the actuating member 841 of the latch switch 84 protrudes outside of the shell of the inner sub assembly 30, and rests between the protrusions 20. Tis is an important feature of the preferred embodiment of the present invention, as it allows the actuating member 841 to be actuated by squeezing the outer surface of the sphere 10 in the vicinity of the actuating member 841. That is, by applying a pressure P to the outer surface of the hollow sphere in the vicinity of the actuating member 841, the sphere 10 can be caused to deform to depress the actuating member 841 to operate the latch switch. In this manner, the LEDs contained within the inner sub-assembly 30 can be turned on and off so as to cause the lighting apparatus to light in response to a user's wishes.

It will also be apparent that as the LEDs are contained within the inner sub-assembly 30 which is itself contained within the sphere 10 that both the materials which form the inner sub assembly 30 and the sphere 10 should be translucent, so as to allow light emitted from the LEDs to be defused and transmitted therethrough.

In the preferred embodiment of the invention the hollow elastomeric body in the form of a sphere has been described as being made of silicone, although it should be understood that other materials with elastomeric properties could also be used, such as, for example, rubber or other similar polymers.

With respect to the inner sub-assembly 30, this is preferably formed from a rigid material so as to provide a measure of protection for the electrical components contained therein. Preferably materials for the inner sub-assembly are hard plastics such as polypropylene. As the LEDs are contained within the inner sub-assembly, the material forming the sub-assembly should preferably be translucent to allow light to be transmitted therethrough. However, the assembly could also be formed of, for example, metal mesh wherein the light is transmitted through the holes in the mesh.

In addition, whilst the preferred embodiment of the invention presents the hollow elastomeric body in the form of a sphere, the body may in fact be any convenient shape that can be readily formed. In particular, other shapes such as cubes, pyramids, or more complicated multiple-sided hedral shapes are envisaged. However, the body is not limited to geometric shapes, and may also be formed in the shape of almost any everyday object, such as, for example, cars, telephones, saucer shapes or any other shape.

In an alternative embodiment of the invention, the battery pack 32 and the electrical input terminal 36 are replaced by a power cord electrically coupled to the PCB 82 and which extends from within the hollow elastomeric body 10 through the aperture 12 to connect to an external power supply. The power supply could for example be a mains socket, although in order to avoid problems with dealing with mains voltage within the lighting apparatus itself, it is preferred that a regulated DC power supply is provided to which the powercord connects in order to provide low voltage DC within the apparatus itself.

Where such a cord is provided, the aperture in the hollow elastomeric body through which the cord extends is preferably provided with cord support or gripping means in order to hold the cord in place, to prevent any stress being placed upon the electrical terminals within the lighting apparatus which may be caused by applying tension onto the power cord in any way.

In yet further embodiments, the exterior surface of the hollow elastomeric body can be treated with a powder agent such as talcum powder so as to improve the texture and feel of the surface to the user. In addition, the powder agent can include a scent agent in order to give the lighting apparatus a scent.

With respect to the LEDs disposed within the lighting apparatus, these LEDs can be arranged such that they each produce the same colour light, or they each produce different coloured light. In addition, it is also possible to use multi colour LEDs which each produce a different colour light depending upon a control signal being applied thereto. In another embodiment of the invention to be described next, control of the light emitted by the light apparatus is performed by an integrated circuit using pulse width modulation.

Figure 16:
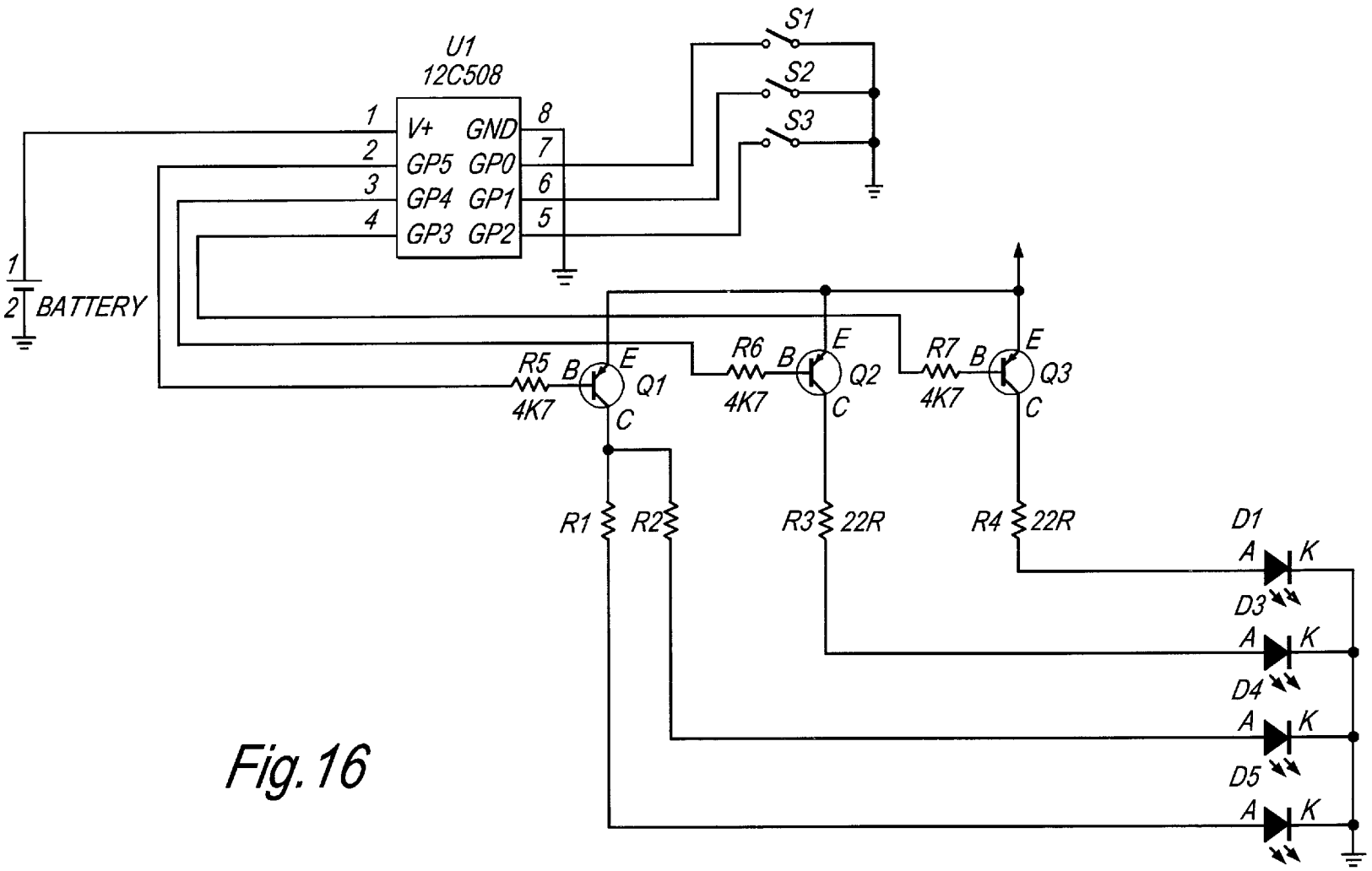
FIG. 16 is a circuit diagram of an electrical circuit which can be employed to control the light-emitting means in an alternative embodiment of the present invention.

FIG. 16 illustrates a circuit diagram of an electrical control circuit which is used to control the LEDs in an alternative embodiment of the invention to the preferred embodiment. The other elements of the alternative embodiment other than the control circuit remain identical to those of the preferred embodiment described above. The only difference therefore is in the electrical control circuit, which causes the tracks on the PCB 82 to have a different layout. Furthermore, the components which form the control circuit of the alternative embodiment are also mounted on the PCB 82 in appropriate mountings.

The control circuit of the alternative embodiment is described next with reference to FIG. 16. More particularly, the circuit comprises an integrated circuit (IC) U1 which is an IC known per se in the art by the serial no. 12C508. The IC has a number of output pins 1 to 8, pin 1 being connected to the positive output terminal of a battery, and pin 2 being connected to ground. Pins 2, 3 and 4 of the ICU1 are respectively connected via resistors R5, R6 and R7 to the base terminals of PNP transistors Q1, Q2, and Q3. The respective emitter terminals of the PNP transistors Q1, Q2 and Q3 are each connected to a power supply rail derived from the positive terminal of the battery (not shown). The collector terminal of transistor Q1 is connected via resistors R1 and R2 which are arranged in parallel to two light emitting diodes D4 and D5 respectively. Diode D4 is arranged in series with resistor R2, and diode D5 is arranged in series with resistor R1. The negative terminals of diodes D4 and D5 are connected to ground.

The collector terminal of transistor Q2 is connected via resistor R3 to the positive terminal of diode D3, the negative terminal of which is connected to ground. Furthermore, the collector terminal of transistor Q3 is connected via resistor R4 to the positive terminal of diode D1, the negative terminal of which is also connected to ground.

Returning to a consideration of the ICU1, pins 5, 6 and 7 are respectively connected via single pole switches S3, S2 and S1 to the ground terminal.

The operation of the electric control circuit of FIG. 16 is described as follows;

Transistors Q1, Q2 and Q3 act as drive transistors for the diodes D1, D3, D4 and D5. That is, the transistors Q1, Q2 and Q3 merely act as switches in response to the control signals applied from the ICU1 to their respective base terminals in order to switch electric current through the respective diodes D1, D3, D4 and D5. The current through each diode is limited by respective resistors R4, R3, R2 and R1, in order to place an upper limit on the brilliance of the light produced by the LEDs. The control signals applied to the base terminals of We transistors Q1, Q2 and Q3 are derived from the ICU1 in accordance with a lighting program stored therein. In this respect the ICU1 is arranged to control the diodes using pulse width modulation, that is by applying pulses of different widths to the base terminals of the respective transistors Q1, Q2 and Q3. In the circuit, the switches S1, S2 and S3 allow control of the IC to indicate to the IC which of the diodes should be lit.

Further description of the pulse width modulation technique to control the intensity of the LEDs is given below.

As mentioned previously, the upper level of brilliance of the each LED is fixed by a series resistor (R1, R2, R3 and R4 ) which limits the current drawn to each diode. The ICU1 applies control pulses of different widths to the base terminals of transistors Q1, Q2 and Q3 to control the intensity of each LED from the upper point of the brilliance fixed by each series resistor. The pulse width modulation technique consists of turning a particular LED on for a period ($P_{on}$) by applying a pulse to the base of the appropriate drive transistor (Q1, Q2 or Q3 ) and then off for a period ($P_{off}$) where, for example, the time periods $P_{on}+P_{off}$ equal 20 milliseconds, for example. In this case, if $P_{on}=P_{off}=10$ milliseconds, then the LED will appear to be "half" on, due to the fact that the on/off cycling is not visible to the eye. In this example, if $P_{on}=20$ milliseconds, and $P_{off}=0$ milliseconds, then the LED is forced to be fully on. By varying the duty cycle between the periods $P_{on}$ and $P_{off}$ an intermediate ratio will allow for intermediate light levels to be reduced, in accordance with the ratio $$\left(\frac{Pon}{Pon + Poff}\right).$$

In a typical digital implementation using an IC, 128 intermediate different light levels can usually be produced.

The use of pulse width modulation allows for the smooth control of the light level of individual LEDs in an array. Control of each individual LED in the array as provided by the control circuit of the alternative embodiment can produce any desired lighting effect, in accordance with a control program stored in the ICU1.

In addition, the pulse width modulation method allows for an optimisation of light output by pulse time. For a given LED current the use of PWM provides an improvement in light output over non-PWM control. Thus, for example, for a typical green LED pulsed on with 20 milliamps for 1 millisecond and then left off for 1 millisecond compared to the light output achieved it is driven continuously with 10 milliamps, it has been found that the average light output is about 1.5 times greater for the pulse condition. An apparently brighter illumination can therefore be obtained by using pulse control for the same average energy consumption.

The appended claims define the limiting features of the present invention. It should be understood that the features of the dependent claims can be combined with the features of the main claim in any combination, including those combinations not explicitly claimed therein.

What is claimed is:

1. A light apparatus comprising: means for receiving electrical power; at least one light-emitting means electrically coupled to the means for receiving electrical power; at least one light activation means, electrically coupled to the light emitting means and the means for receiving electrical power, the light activation means being arranged to activate the light emitting means as required by a user; and a hollow elastomeric body at least a part of which is substantially translucent; wherein the means for receiving electrical power, the light-emitting means, and the light activation means are substantially disposed within the hollow elastomeric body so as to be at least partially encased thereby, the light emitting means being further arranged with respect to the hollow elastomeric body such that in use light is transmitted through at least one of those parts of the body which are substantially translucent, wherein the light activation means is arranged to be actuable in response to pressure exerted on an exterior surface of the hollow elastomeric body, and wherein said hollow elastomeric body is further provided with means defining cavities therein.

2. A light apparatus according to claim 1, wherein the hollow elastomeric body is resiliently deformable.

3. A light apparatus according to claim 1, wherein the hollow elastomeric body is substantially spherical in shape.

4. A light apparatus according to claim 1, wherein the hollow elastomeric body is formed from silicone.

5. A light apparatus according to claim 1, wherein the hollow elastomeric body is formed from a material having a Shore Hardness rating A of between about 2 to 15.

6. A light apparatus according to claim 1, wherein the hollow elastomeric body is formed from a material having an elongation factor of between about 200 to 400%.

7. A light apparatus according to claim 1, wherein the hollow elastomeric body is formed from a material comprising about 1 to 5% by weight of a diffusing agent.

8. A light apparatus according to claim 1, wherein the means for receiving electrical power further comprises a battery compartment arranged to receive at least one battery.

9. A light apparatus according to claim 8, wherein a rechargeable battery is provided within the battery compartment, and the light apparatus is further provided with an electrical input terminal electrically coupled to the battery, the electrical input terminal being further arranged for receiving an electrical connector for supplying electrical current to the battery.

10. A light apparatus according to claim 1, wherein the means for receiving electrical power further comprises a power cable extending out of the hollow elastomeric body.

11. A light apparatus according to claim 1 wherein the or each light activation means is an electrical latch switch.

12. A light apparatus according to claim 1, wherein said means defining cavities comprise a plurality of inwardly extending protrusions provided on the inner surface of said body.

13. A light apparatus according to claim 12, wherein said protrusions are integrally formed with said body.

14. A light apparatus comprising: means for receiving electrical power; at least one light-emitting means electrically coupled to the means for receiving electrical power; at least one light activation means, electrically coupled to the light emitting means and the means for receiving electrical power, the light activation means being arranged to activate the light emitting means as required by a user; and a hollow elastomeric body at least a part of which is substantially translucent; wherein the means for receiving electrical power, the light-emitting means, and the light activation means are substantially disposed within the hollow elastomeric body so as to be at least partially encased thereby, the light emitting means being further arranged with respect to the hollow elastomeric body such that in use light is transmitted through at least one of those parts of the body which are substantially translucent, wherein the light activation means is arranged to be actuable in response to pressure exerted on an exterior surface of the hollow elastomeric body, and further comprising an inner pod means disposed within the hollow elastomeric body so as to be substantially encased thereby, said means for receiving electrical power and said light-emitting means being disposed within the inner pod means.

15. A light apparatus according to claim 14, wherein said hollow elastomeric body is further provided with means at least partially defining one or more cavities, said means being arranged to contact with said inner pod means to provide one or more substantially enclosed cavities within the hollow elastomeric body.

16. A light apparatus according to claim 15, wherein said means at least partially defining cavities comprise a plurality of inwardly extending protrusions provided on the inner surface of said body, the distal ends of the protrusions being arranged to contact an outer surface of the inner pod means to provide the one or more substantially enclosed cavities.

17. A light apparatus according to claim 14, wherein the inner pod means is formed from substantially rigid material.

18. A light apparatus according to claim 1, wherein the or each light-emitting means comprises a light-emitting diode (LED).

19. A light apparatus according to claim 1, wherein the or each light-emitting means is further arranged to emit light of different colours.

20. A light apparatus according to claim 1, and further comprising a control means for controlling the or each light emitting means to emit light.

21. A light apparatus according to claim 20, wherein the control means controls the or each light-emitting means using pulse width modulation (PWM).

22. A light apparatus according to claim 5, wherein the hollow elastomeric body is formed from a material having a Shore Hardness rating A of about 7.

23. A light apparatus according to claim 4, wherein the hollow elastomeric body is formed from a material having an elongation factor of about 400%.

24. A light apparatus according to claim 7, wherein the hollow elastomeric body is formed from a material comprising about 3% by weight of a diffusing agent.

25. A light apparatus comprising: means for receiving electrical power; at least one light-emitting means electrically coupled to the means for receiving electrical power; at least one light activation means, electrically coupled to the light emitting means and the means for receiving electrical power, the light activation means being arranged to activate the light emitting means as required by a user; and a hollow elastomeric body at least a part of which is substantially translucent; wherein the means for receiving electrical power, the light-emitting means, and the light activation means are substantially disposed within the hollow elastomeric body so as to be at least partially encased thereby, the light emitting means being further arranged with respect to the hollow elastomeric body such that in use light is transmitted through at least one of those parts of the body which are substantially translucent, wherein the light activation means is arranged to be actuable in response to pressure exerted on an exterior surface of the hollow elastomeric body, and wherein the hollow elastomeric body is formed from a material comprising about 1 to 5% by weight of a diffusing agent.

26. A light apparatus according to claim 25, and further comprising an inner pod means disposed within the hollow elastomeric body so as to be substantially encased thereby, said means for receiving electrical power and said light-emitting means being disposed within the inner pod means.

27. A light apparatus according to claim 25, and further comprising a control means for controlling the or each light emitting means to emit light, wherein the control means controls the or each light-emitting means using pulse width modulation (PWM).

28. A light apparatus comprising: means for receiving electrical power; at least one light-emitting means electrically coupled to the means for receiving electrical power; at least one light activation means, electrically coupled to the light emitting means and the means for receiving electrical power, the light activation means being arranged to activate the light emitting means as required by a user; a hollow elastomeric body at least a part of which is substantially translucent; and a control means for controlling the or each light emitting means to emit light, wherein the control means controls the or each light-emitting means using pulse width modulation (PWM); wherein the means for receiving electrical power, the light-emitting means, and the light activation means are substantially disposed within the hollow elastomeric body so as to be at least partially encased thereby, the light emitting means being further arranged with respect to the hollow elastomeric body such that in use light is transmitted through at least one of those parts of the body which are substantially translucent, wherein the light activation means is arranged to be actuable in response to pressure exerted on an exterior surface of the hollow elastomeric body.

29. A light apparatus according to claim 28, and further comprising an inner pod means disposed within the hollow elastomeric body so as to be substantially encased thereby, said means for receiving electrical power and said light-emitting means being disposed within the inner pod means.

* * * * *